US006895659B2

(12) United States Patent
Moon et al.

(10) Patent No.: US 6,895,659 B2
(45) Date of Patent: May 24, 2005

(54) PROCESS OF MANUFACTURING FLUID JETTING APPARATUSES

(75) Inventors: Jae-ho Moon, Suwon (KR); Jong-chun Kim, Suwon (KR); Sung-hee Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 09/426,644

(22) Filed: Oct. 25, 1999

(65) Prior Publication Data

US 2002/0080212 A1 Jun. 27, 2002

(30) Foreign Application Priority Data

Oct. 26, 1998 (KR) ..... 98-44825

(51) Int. Cl.[7] ..... H05B 3/10; B21D 53/76; B41J 2/345

(52) U.S. Cl. ..... 29/611; 29/890.1; 29/417; 347/56; 347/61; 347/62; 156/248; 156/250; 427/240; 427/407.1

(58) Field of Search ..... 347/26, 41, 56, 347/61, 62, 63, 65; 29/611, 890.1, 418, 423, 412, 417; 216/27, 66; 156/247, 248, 250, 254; 427/240, 407.1, 385.5

(56) References Cited

U.S. PATENT DOCUMENTS

| | | | | | |
|---|---|---|---|---|---|
| 4,371,565 | A | * | 2/1983 | Baise et al. | 427/407.1 |
| 4,480,259 | A | | 10/1984 | Kruger et al. | |
| 4,638,337 | A | * | 1/1987 | Torpey et al. | 347/65 |
| 4,678,529 | A | * | 7/1987 | Drake et al. | 156/254 |
| RE32,572 | E | * | 1/1988 | Hawkins et al. | 216/27 |
| 4,878,992 | A | * | 11/1989 | Campanelli | 216/27 |
| 4,894,664 | A | * | 1/1990 | Pan | 29/611 |
| 5,006,202 | A | * | 4/1991 | Hawkins et al. | 216/27 |
| 5,057,853 | A | * | 10/1991 | Fisher | 29/890.1 |
| 5,229,785 | A | * | 7/1993 | Leban | 29/890.1 |
| 5,719,605 | A | | 2/1998 | Anderson et al. | |
| 5,850,241 | A | * | 12/1998 | Silverbrook | 216/27 |
| 6,089,700 | A | * | 7/2000 | Ahn | 347/61 |
| 6,127,198 | A | * | 10/2000 | Coleman et al. | 29/890.1 |

FOREIGN PATENT DOCUMENTS

| | | | |
|---|---|---|---|
| EP | 0816083 | 1/1998 | |
| JP | 59-026270 | 2/1984 | |
| JP | 5-338186 | * 12/1993 | 29/890.1 |
| JP | 06-198895 | 7/1994 | |
| JP | 10-058691 | 3/1998 | |
| JP | 10-181029 | 7/1998 | |
| JP | 10-226077 | 8/1998 | |

* cited by examiner

*Primary Examiner*—A. Dexter Tugbang
(74) *Attorney, Agent, or Firm*—Stein, McEwen & Bui, LLP

(57) ABSTRACT

A manufacturing process in which a plurality of fluid jetting apparatuses are formed includes forming and sequentially adhering a heat driving part, a membrane and a nozzle part, respectively. The fluid jetting apparatuses are completed as a wafer unit by forming the nozzle part by forming a nozzle plate on a substrate of a wafer by a spinning process; forming jetting fluid barriers on the nozzle plate by the spinning process; forming jetting fluid chambers in the jetting fluid barriers; forming nozzles in the nozzle plate; and separating the substrate from the nozzle plate after the nozzle part and the membrane are adhered to each other. The forming jetting fluid chambers is accomplished by a process of wet etching, and the forming nozzles is accomplished by a treating apparatus of a laser beam or by a process of reactive ion etching.

11 Claims, 12 Drawing Sheets

PROCESS OF MANUFACTURING FLUID JETTING APPARATUSES

CROSS-REFERENCE TO RELATED APPLICATIONS

This application claims the benefit of Korean Application No. 98-44825, filed Oct. 26, 1998 in the Korean Patent Office, the disclosure of which is incorporated herein by reference.

BACKGROUND OF THE INVENTION

1. Field of the Invention

The present invention relates to a fluid jetting apparatus, and more particularly, to the process of manufacturing a plurality of fluid jetting apparatuses, making use of a method of a polyimide nozzle which is capable of adapting to a print head in an output unit of an ink jet printer and a facsimile machine and the like.

2. Description of the Related Art

A print head is a part or a set of parts which is capable of converting output data introduced from a printer into something visible. Generally, the print head used for an ink jet printer and the like uses a fluid jetting apparatus which is capable of jetting a predetermined fluid held in a fluid chamber through a nozzle to the exterior by applying a physical force to the fluid in the fluid chamber.

FIG. 1 is a vertical cutaway view of a fluid jetting apparatus according to a conventional method of thermo-compression. The fluid jetting apparatus comprises roughly a heat driving part 10, a membrane 20 and a nozzle part 30. The method of thermo-compression is a method for heating a liquid instantly to vaporize the same and for jetting ink by driving the membrane 20.

The heat driving part 10 is formed by laminating an insulating layer 12, an electrode 13, a heat element 14 and a driving fluid barrier 15, sequentially on a substrate 11. At the etching part of the driving fluid barrier 15 a driving fluid chamber 16 is formed which is full of a driving fluid expandable by heat.

The membrane 20 is a thin diaphragm, and is driven toward the jetting fluid chamber 33 by the driving fluid which is heated by the heat element 14.

The nozzle part 30 contains a jetting fluid barrier 31 and a nozzle plate 32. At the etching part of the jetting fluid barrier 31 the jetting fluid chamber 33 is formed which is full of jetting fluid, and a nozzle 34 is formed in the nozzle plate for jetting the jetting fluid in the jetting fluid chamber 33 through the nozzle 34.

With reference to the above-mentioned structure of FIG. 1, the operations of the fluid jetting apparatus according to the thermo-compression method are as follows.

To begin with, if a power source is applied to the electrode 12, the heat element 14 generates heat, and the driving fluid in the driving fluid chamber 16 is expanded by the heat in order to push the membrane 20 toward an upper direction as shown in FIG. 1. As the membrane 20 is pushed toward the upper direction, the jetting fluid in the jetting fluid chamber 33 is jetted to the exterior of the jetting fluid apparatus through the nozzle 34. This method is so called the thermo-compression method, and other methods for jetting fluid are classified as a heating method and a piezoelectric method and the like, according to the means for applying physical forces to the jetting fluid.

Meanwhile, the conventional material of the nozzle plate 32 is mainly a metal made of nickel, but the trend in using a material such as a polyimide synthetic resin has increased recently. When the nozzle plate 32 is made of the polyimide synthetic resin, it is fed by a reel type. In feeding the nozzle plate 32 in the reel type, the fluid jetting apparatus is completed by the way it is bonded at once from the substrate of a silicon wafer to the jetting fluid barrier.

FIG. 2 shows a process of manufacturing the fluid jetting apparatus according to the conventional roll method. As shown in FIG. 2, the nozzle plate 32 rolls from a feeding reel 51 to a take-up reel 52. In the rolling process of the nozzle plate 32 from the feeding reel 51 to the take-up reel 52, a nozzle is formed at the nozzle plate 32 by a treating apparatus 53 using a laser beam. After the nozzle is formed, some air which is jetted from an air blower 54 eliminates extraneous substances attached to the nozzle plate 32. Next, an actuator chip 40, which is laminated from the substrate to the jetting fluid barrier, is bonded with the nozzle plate 32 by a tab bonder 55, and accordingly the fluid jetting apparatus is completed. The completed apparatus is wound to be preserved in the take-up reel 52, and then it is sectioned piece by piece in the manufacturing process of the print head. Accordingly, each piece of the apparatus is supplied into the manufacturing line of a printer.

But, in the process of manufacturing the fluid jetting apparatus according to the conventional roll method, with the exception of the nozzle plate formed on the silicon wafer, the semi-manufactured chips are sectioned piece by piece, and they are bonded with individual chips on the nozzle plate. Accordingly, there is a problem that the productivity is lowered due to a significant manufacturing time.

SUMMARY OF THE INVENTION

The present invention has been designed to overcome the above problems, and accordingly, it is a first object of the present invention to provide a process of manufacturing a plurality of fluid jetting apparatuses at once in the shape of a wafer due to formation by means of a spinning process.

To achieve the above and other objects of the present invention, a process of manufacturing a plurality of fluid jetting apparatuses at once in the shape of a wafer comprises forming a nozzle part by a spinning process, and adhering a membrane to a heat driving part and the nozzle part, to form the heat driving part, membrane and nozzle part sequentially, to form the fluid jetting apparatuses as a wafer unit. Thus, the completion as a wafer unit results in that the end product of the manufacturing process is a plurality of fluid jetting apparatuses which form the shape of a wafer. With much convenience, a user can cut the wafer into the respective fluid jetting apparatuses as necessary. In other words, the wafer is an integrity of the plurality of fluid jetting apparatuses.

The heat driving part is formed by a method which comprises a first step of forming a plurality electrodes and a plurality of heating elements on a first substrate of a wafer; a second step of forming driving fluid barriers on the electrodes and the heating elements; and a third step of forming driving fluid chambers in the driving fluid barriers.

The membrane is formed by a method comprising a first step of forming a polyimide coating layer on a second substrate of a wafer; and a second step of separating the second substrate from the polyimide coating layer. Additionally, a step of coating an adhesive polyimide on the polyimide coating layer is performed after carrying out the first step. The first step is preferably accomplished by the spinning process. Also, a step of attaching a first reinforcing ring on the polyimide coating layer is performed, and the first reinforcing ring is separated from the polyimide coating layer after the membrane and the nozzle part are adhered to each other.

The nozzle part is formed by a method comprising a first step of forming a nozzle plate on a third substrate of a wafer by a spinning process; a second step of forming jetting fluid barriers on the nozzle plate by the spinning process; a third step of forming jetting fluid chambers in the jetting fluid barriers; a fourth step of forming nozzles in the nozzle plate; and a fifth step of separating the third substrate from the nozzle plate. The fifth step is preferably accomplished after the nozzle part and the membrane are adhered to each other. A step of attaching a second reinforcing ring beneath the third substrate is performed before the first step is accomplished, and the second reinforcing ring and the third substrate are separated altogether after the nozzle part and the membrane are adhered to each other. The third step is accomplished by the process of wet etching. The fourth step is accomplished by a treating apparatus of a laser beam, or is accomplished by the process of reactive ion etching.

To further achieve the above and other objects of the present invention, there is provided a method of manufacturing fluid jetting apparatuses, comprising a first step of forming a heat driving part which is sequentially formed of electrodes, a heat elements and driving fluid barriers on a first substrate of silicon wafer, and driving fluid chambers formed in the driving fluid barriers; a second step of forming a membrane on which is coated a polyimide and an adhesive polyimide as a coating layer on a second substrate of silicon wafer, sequentially, and the membrane (the polyimide layer) is separated from the second substrate after a first reinforcing ring is attached on the coating layer of the adhesive polyimide; a third step of forming a nozzle part with a nozzle plate and jetting fluid barriers sequentially on a third substrate of a silicon wafer attached to a second reinforcing ring beneath the third substrate by a spinning process, forming jetting fluid chambers in the jetting fluid barriers, and forming a nozzle in the nozzle part; a fourth step of adhering the polyimide coating layer of the membrane to the jetting fluid barriers, and of separating the nozzle plate from the second reinforcing ring and the third substrate of the silicon wafer; and a fifth step of adhering the coating layer of the adhesive polyimide of the membrane to the driving fluid barriers of the heat driving part.

The coating of the second step is preferably accomplished by a spinning process. The nozzle forming of the third step is accomplished by a treating apparatus of a laser beam, or is accomplished by the process of reactive ion etching.

Accordingly, in the process of manufacturing the fluid jetting apparatus according to the present invention, since the nozzle part is formed on the silicon wafer by the spinning process, this nozzle part is capable of adhering to the membrane in the wafer status, and then the fluid jetting apparatuses are completed at once in the shape of a wafer. Thus, different from the conventional manufacturing method, in which the fluid jetting apparatuses are made one by one, the manufacturing method according to the present invention manufactures a plurality of fluid jetting apparatuses at once in the shape of a wafer. Therefore, the manufacturing time of the fluid jetting apparatuses are significantly shortened from the manufacturing time of the conventional manufacturing process.

BRIEF DESCRIPTION OF THE DRAWINGS

The above objects and advantages will be more apparent by describing the present invention with reference to the accompanied reference drawings, in which.

DESCRIPTION OF THE PREFERRED EMBODIMENT

The present invention will become more apparent by describing in detail in a preferred embodiment thereof with reference to the attached drawings.

FIGS. 3A through 3D show a process of manufacturing fluid jetting apparatuses according to an embodiment of the present invention, and the fluid jetting apparatuses are formed of a heat driving part, a membrane and a nozzle part, respectively.

Figure 1:
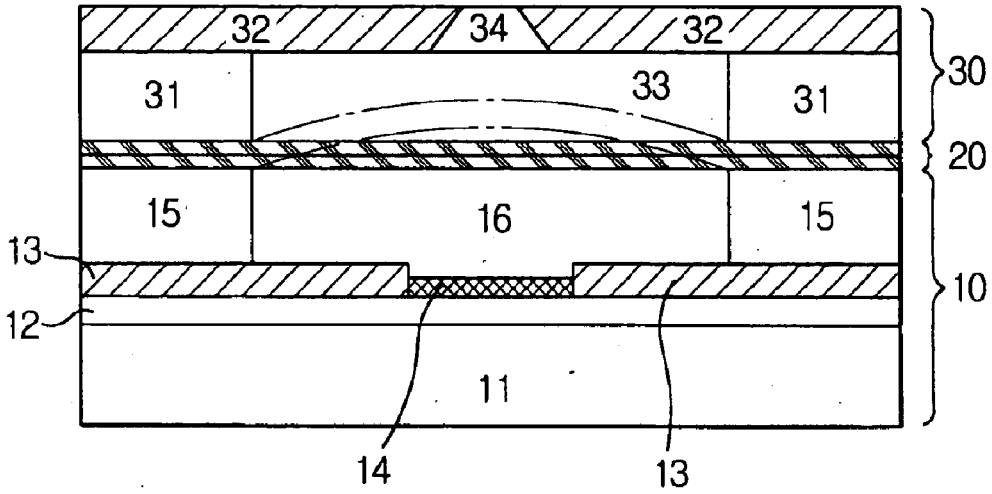
FIG. 1 (PRIOR ART)
FIG. 1 is a vertical cutaway view of a fluid jetting apparatus according to a conventional thermo-compression method.
Figure 2:
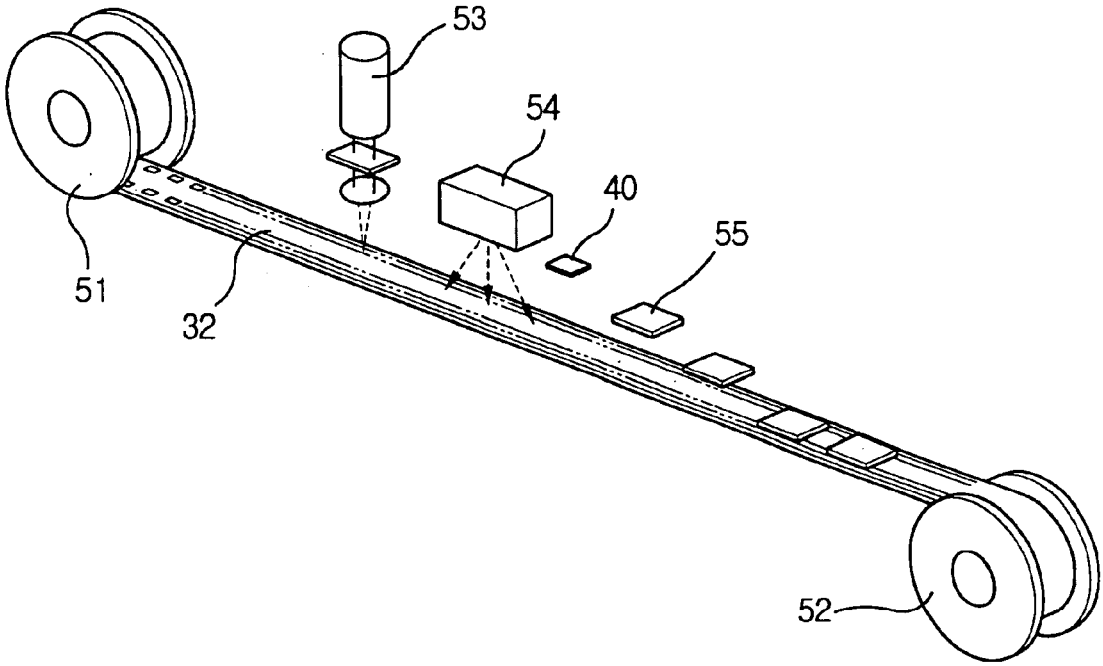
FIG.2 (PRIOR ART)
FIG. 2 shows the process of manufacturing a plurality of fluid jetting apparatuses according to a conventional roll method.
Figure 3A:
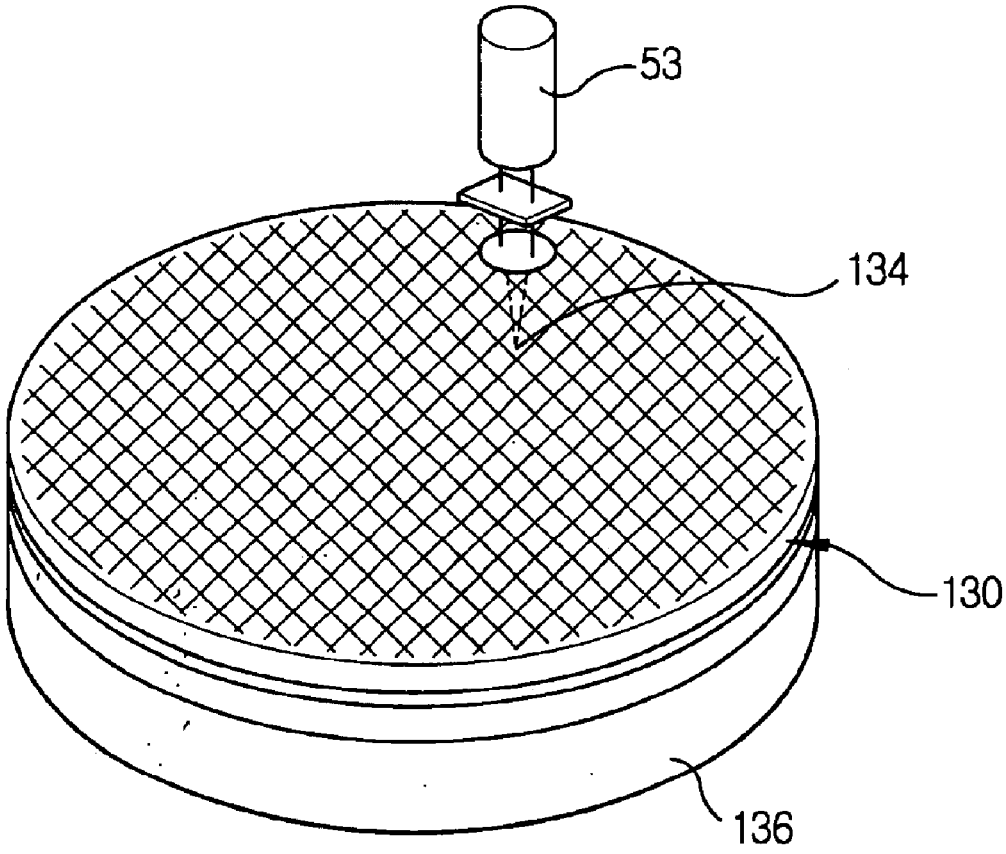
FIGS. 3A and 3D show the process of manufacturing a plurality of fluid jetting apparatuses according to an embodiment of the present invention.
Figure 3B:
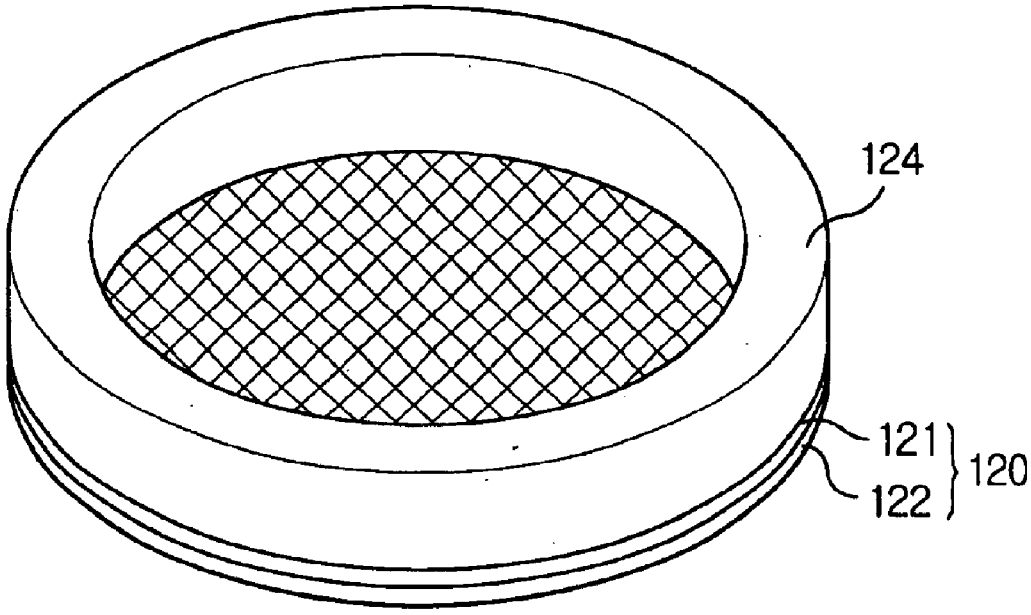
Figure 3C:
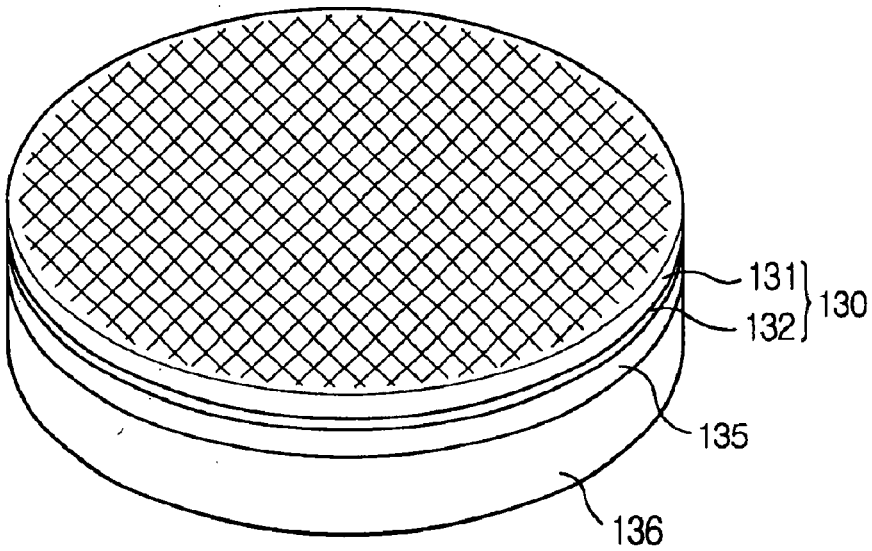
Figure 3D:
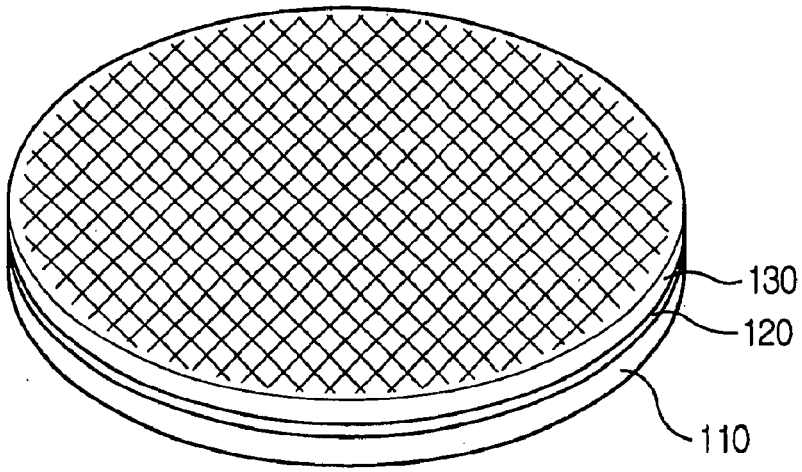

In FIG. 3A and FIG. 3C, the reference numeral 53 is a treating apparatus of a laser beam, the reference numeral 130 is a nozzle part, the reference numeral 135 is a third silicon wafer, and the reference numeral 136 is a second reinforcing ring. In FIG. 3B, the reference numeral 120 is a membrane, the reference numeral 121 is an adhesive coating layer of polyimide, the reference numeral 122 is a polyimide coating layer, and the reference numeral 124 is a first reinforcing ring. The reference numeral 110 is a heat driving part as shown in FIG. 3D, and thus FIG. 3D shows that the fluid jetting apparatuses of a wafer unit are completed by adhering the nozzle part 130 to the membrane 120 and the membrane 120 on the heat driving part 110.

FIG. 3A shows that nozzles 134 are formed in the nozzle part 130 by using the treating apparatus 53 of a laser beam according to a spinning process, and FIG. 3B shows that the membrane 120 is formed by using the first reinforcing ring 124. FIG. 3C shows that the nozzle part 130 is formed by being combined with the second reinforcing ring 136, and FIG. 3D shows the fluid jetting apparatuses of a wafer unit which are completed by adhering the nozzle part 130, the membrane 120 and the heat driving part 110, respectively.

Figure 4A:
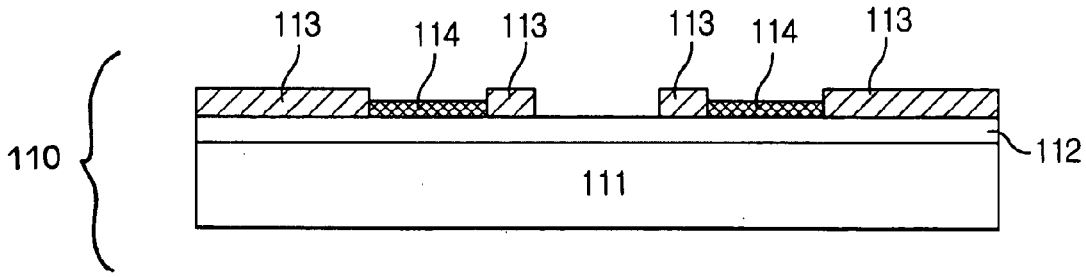
FIGS. 4A and 4B show the process of manufacturing a heat driving part of a fluid jetting apparatus according to the embodiment of the present invention.
Figure 4B:
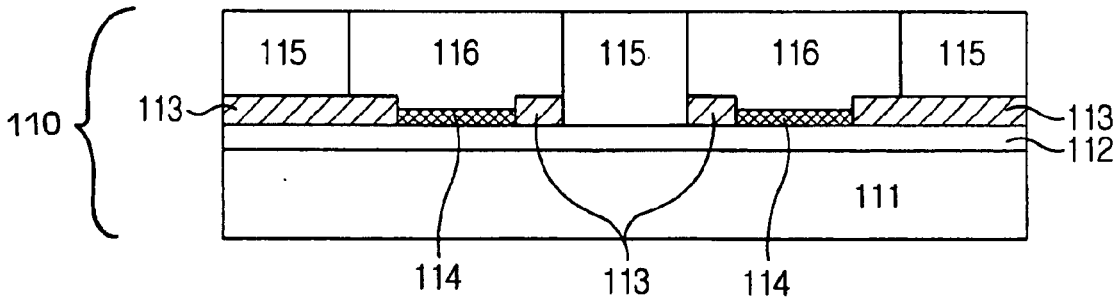

FIGS. 4A and 4B show the process of manufacturing a heat driving part 110 of the fluid jetting apparatuses according to the embodiment of the present invention. The reference numeral 111 is a first substrate of silicon wafer, the reference numeral 112 is an insulating layer, and the reference numeral 113 represents electrodes. The reference numeral 114 represents heat elements, the reference numeral 115 represents driving fluid barriers, and the reference numeral 116 represents represents driving fluid chambers.

As shown in FIG. 4A, the heat driving part 110 is formed by sequentially forming the electrodes 113 and the heat elements 114 on the insulating layer 112 over the first substrate of silicon wafer 111. The electrodes 113 are formed preferably by using a lithography process or a wet etching process. The heat elements 114 use material of tantal-aluminum TaAl or polysilicon $H_5B_2$, and are formed preferably by the lithography process, the sputtering process or the lift-off process.

As shown in FIG. 4B, the driving fluid barriers 115 are formed on the electrodes 113 and the heat elements 114. The driving fluid barriers 115 are firstly coated by polyimide according to the spinning process, and then they are cured. The driving fluid barriers 115 are then patterned with a metal mask, and are formed by means of a process of dry etching.

Figure 5A:
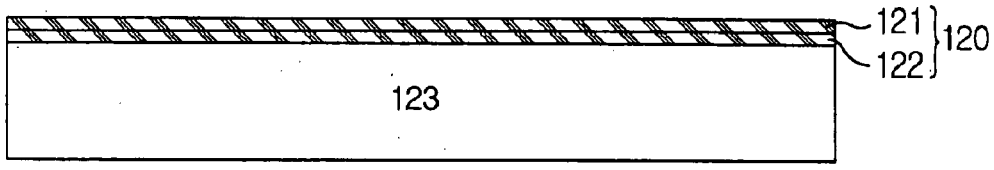
FIGS. 5A and 5C show the process of manufacturing a membrane of the fluid jetting apparatus according to the embodiment of the present invention.
Figure 5B:
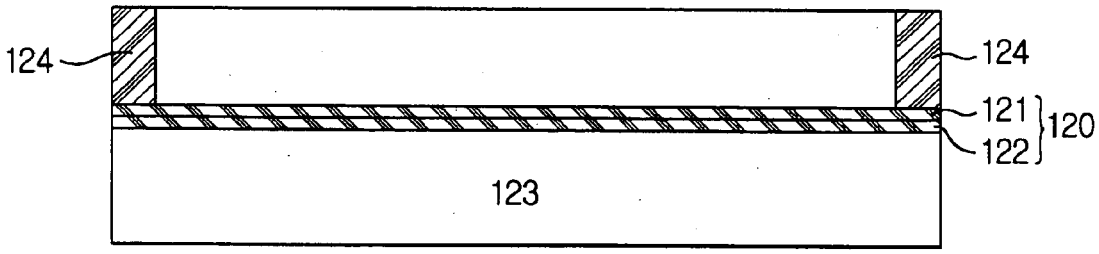
Figure 5C:
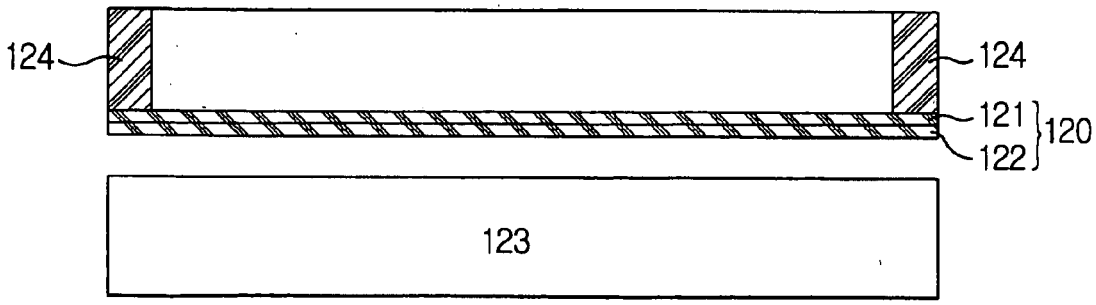

FIGS. 5A through 5C show the process of manufacturing a membrane 120 of a plurality of fluid jetting apparatuses according to the embodiment of the present invention. The reference numeral 123 is a second substrate of silicon wafer.

As shown in FIG. 5A, the membrane 120 is coated sequentially with the polyimide coating layer 122 and the adhesive coating layer 121 by means of a spinning process. As shown in FIG. 5B, the first reinforcing ring 124 is attached on the adhesive coating layer 121, and the coating layer 122 of polyimide, as shown in FIG. 5C, is separated from the second substrate of silicon wafer 123. Accordingly, the membrane 120 which is attached to the first reinforcing ring 124 is formed.

FIGS. 6A through 6D show the process of manufacturing the nozzle part 130 (shown in FIG. 6D) of the fluid jetting apparatuses according to the embodiment of the present invention. The reference numeral 131 represents jetting fluid barriers, the reference numeral 132 is a nozzle plate, and the reference numeral 133 represents jetting fluid chambers.

Figure 6A:
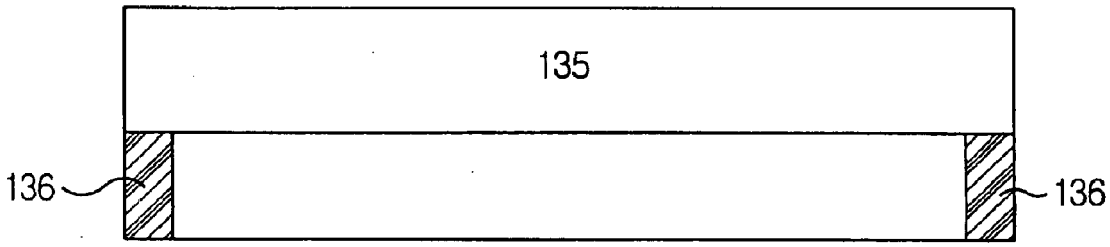
FIGS. 6A and 6D show the process of manufacturing a nozzle part of the fluid jetting apparatus according to the embodiment of the present invention.
Figure 6B:
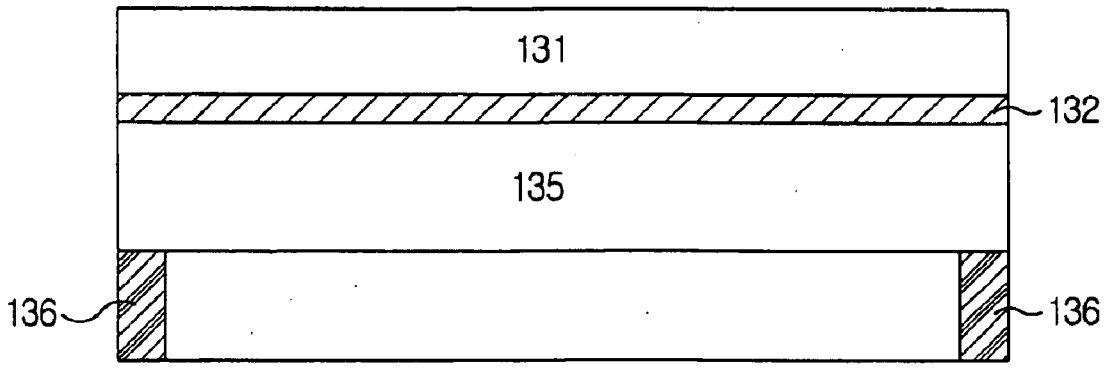

As shown in FIG. 6A, the nozzle part 130 is attached to the second reinforcing ring 136 beneath the third substrate of silicon wafer 135. As shown in FIG. 6B, the nozzle plate 132 and the jetting fluid barriers 131 are sequentially formed on the third substrate of silicon wafer 135. The nozzle plate 132 is made of the material polyimide, and the jetting fluid barriers 131 are made of an adhesive polyimide, and thus, they are formed by a spinning process and a curing process, respectively.

Figure 6C:
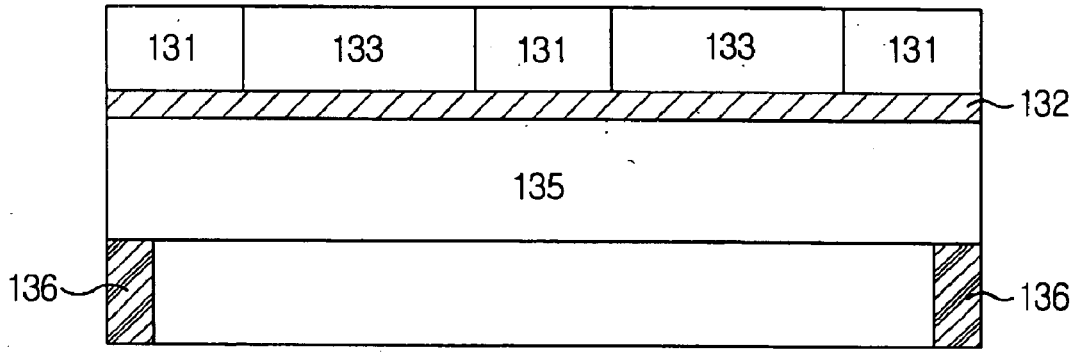
Figure 6D:
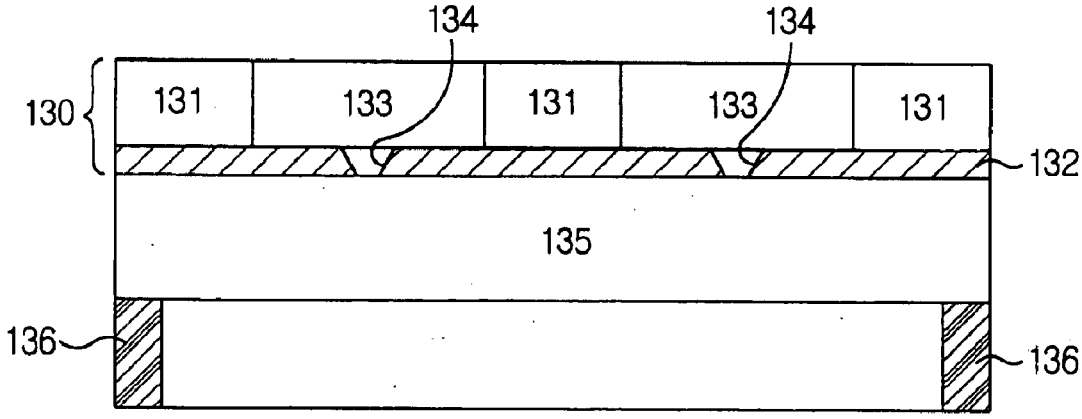

As shown in FIG. 6C, the jetting fluid chambers 133 are formed in the jetting fluid barriers 131 by means of a patterning process and a dry etching process. Next, as shown in FIG. 6D with reference to the above mentioned FIG. 3A, the nozzles 134 which pass the jetting fluid chambers 133 are formed in the nozzle plate 132 by means of using a laser beam of the treating apparatus 53 or an etching process of reactive ions.

Through the above-described process, the heat driving part 110, the membrane 120 and the nozzle part 130 are formed, respectively, and then adhered to each other.

Figure 7A:
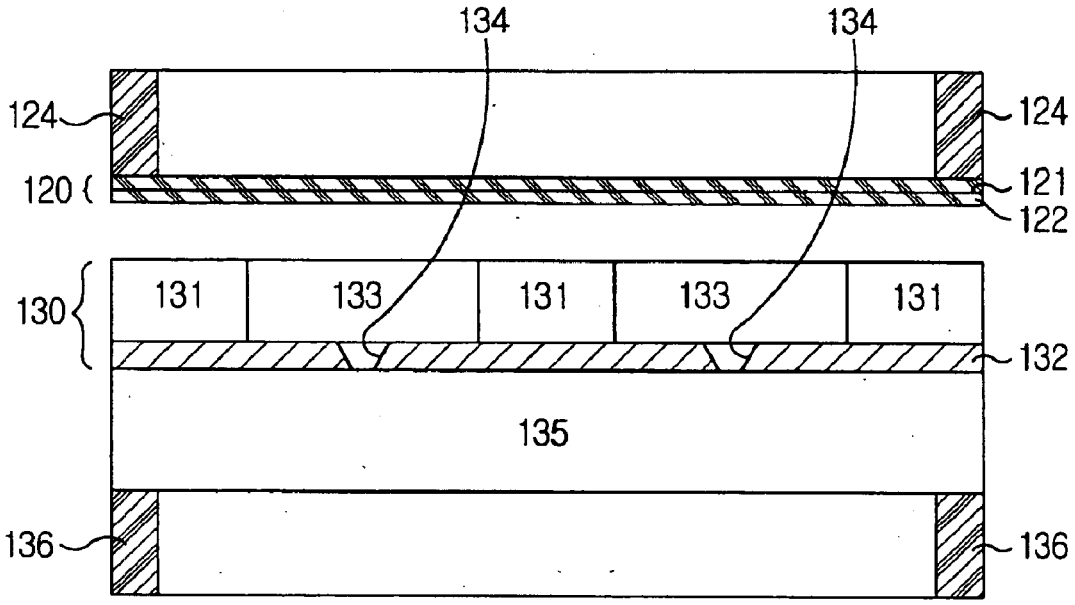
FIGS. 7A and 7C show the process of adhering the membrane and the nozzle part of a fluid jetting apparatus according to the embodiment of the present invention.
Figure 7B:
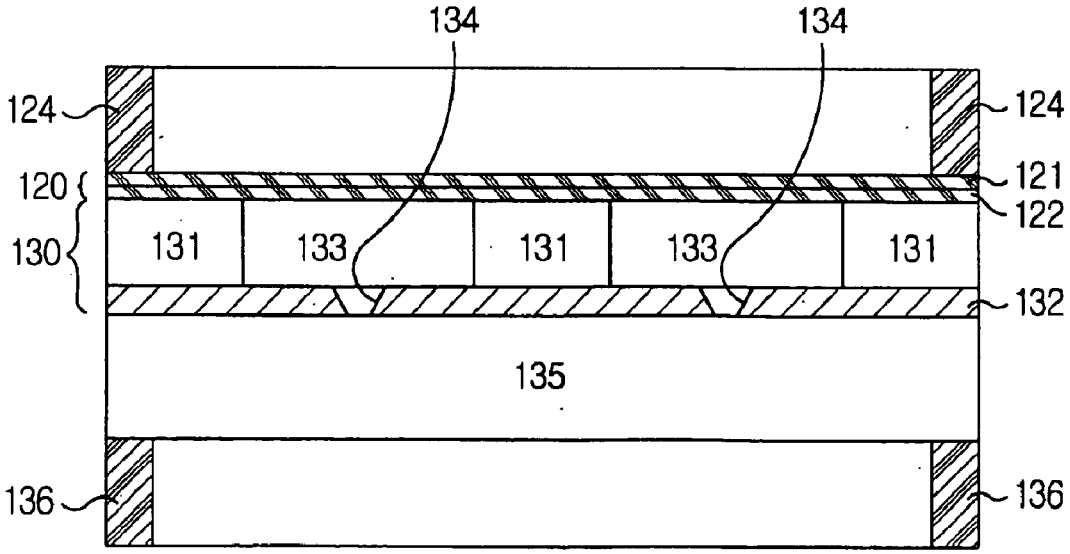
Figure 7C:
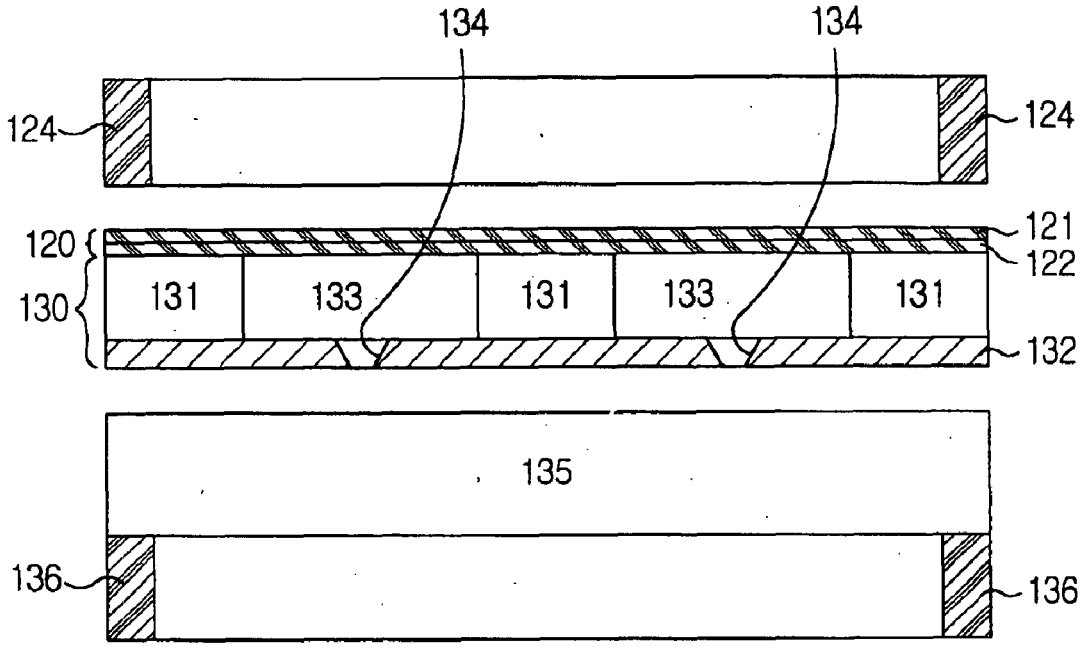

To begin with, the membrane 120 and the nozzle part 130 are adhered. FIGS. 7A through 7C show the process of adhering the membrane 120 and the nozzle part 130 of the fluid jetting apparatuses according to the embodiment of the present invention.

In the status of the membrane 120 and the nozzle part 130 as shown in FIG. 7A, the coating layer of polyimide 122 is attached to the upper part of the jetting fluid chamber 131 in the nozzle part 130 which is formed on the third substrate of the silicon wafer 135 as shown in FIGS. 7A and 7B. As shown in FIG. 7C, the first reinforcing ring 124 and the third substrate of silicon wafer 135 are separated from the membrane 120 and the nozzle part 130, respectively.

Figure 8A:
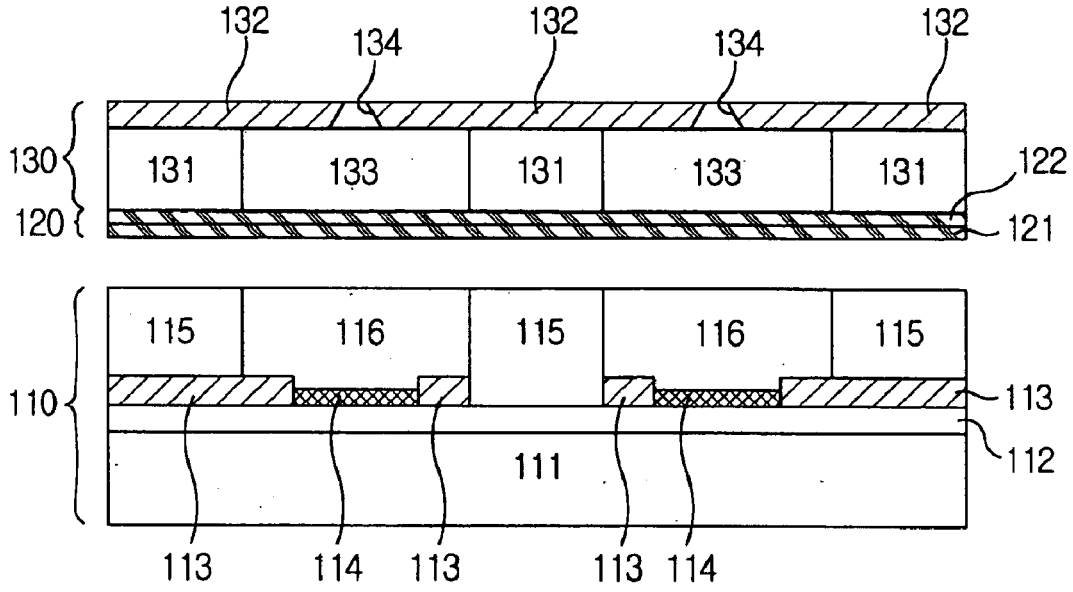
FIGS. 8A and 8B show the process of adhering the heat driving part and the membrane adhered to the nozzle part according to the embodiment of the present invention.
Figure 8B:
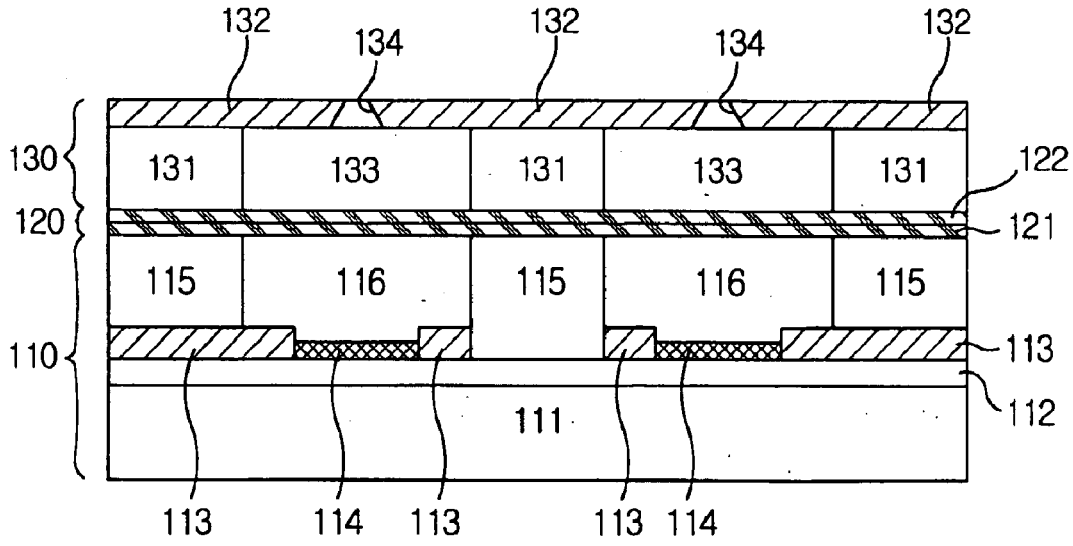

FIGS. 8A and 8B show the process of adhering the heat driving part to the membrane adhered to the nozzle part according to the embodiment of the present invention.

The adhered nozzle part 130 and membrane 120 as above-mentioned, are reversed as shown in FIG. 8A relative to the positioning shown in FIG. 7C, and then the process of manufacturing the fluid jetting apparatuses is completed by adhering the adhesive coating layer of polyimide 121 on the upper part of the driving fluid barriers 115 of the heat driving part 110.

The completed jetting fluid apparatuses have the form of a wafer unit as above-described in FIG. 3D. Accordingly, for the sake of dicing and packaging the jetting fluid apparatuses, the wafer is cut into sections piece by piece as a single chip, and then it is supplied into the subsequent process of manufacturing the print head.

According to the above-described invention, since the nozzle part is formed on the silicon wafer by means of the spinning process, it is capable of adhering to the membrane in the shape of a wafer. Accordingly, the fluid jetting apparatuses are completed in the shape of the wafer all at once. As a result, the end product of the manufacturing process is a plurality of fluid jetting apparatuses which form the shape of a wafer. With much convenience, a user can cut the wafer into the respective fluid jetting apparatuses as necessary. In other words, the wafer is an integrity of the plurality of fluid jetting apparatuses. Besides, since the manufacturing time of each jetting fluid apparatus (time to manufacture the fluid jetting apparatuses) according to the present invention as compared with the manufacturing time of a jetting fluid apparatus according to a conventional method is reduced, the present invention is capable of improving productivity.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A process of manufacturing a plurality of fluid jetting apparatuses, comprising:

forming electrodes and heat elements on a first substrate of silicon wafer, forming driving fluid barriers on the electrodes and heat elements, and driving fluid chambers in the driving fluid barriers, to form a heat driving part;

forming a polyimide coating layer on a second substrate of silicon wafer, forming an adhesive polyimide coating layer on the polyimide coating layer, attaching a first reinforcing ring to the adhesive polyimide coating layer, and separating the polyimide coating layer from the second substrate after attaching the first reinforcing ring on the adhesive polyimide coating layer, to form a membrane;

attaching a second reinforcing ring beneath a third substrate of silicon wafer by a spinning process, forming a nozzle plate on an opposite side of the third substrate from that of the second reinforcing ring, forming jetting fluid barriers on the nozzle plate, forming jetting fluid chambers in the jetting fluid barriers, and forming nozzles in the nozzle part;

adhering the polyimide coating layer of the membrane to the jetting fluid barriers, and separating the second reinforcing ring and the third substrate of silicon wafer, from the nozzle plate; and adhering the adhesive polyimide coating layer of the membrane to the driving fluid barriers of the heat driving part.

2. The process of manufacturing a plurality of fluid jetting apparatuses as claimed in claim 1, wherein the forming of the polyimide coating layer on the second substrate and the forming of the adhesive polyimide coating layer on the polyimide coating layer are accomplished by the spinning process.

3. The process of manufacturing a plurality of fluid jetting apparatuses as claimed in claim 1, wherein the forming of the nozzles in the nozzle plate is accomplished by using a laser beam from a treating apparatus.

4. The process of manufacturing a plurality of fluid jetting apparatuses as claimed in claim 1, wherein the forming of the nozzles in the nozzle plate is accomplished by a process of reactive ion etching.

5. A process of manufacturing a plurality of fluid jetting apparatuses at once, comprising:

forming a nozzle part on a silicon wafer by a spinning process;

adhering the nozzle part with the silicon wafer to a membrane;

removing the silicon wafer from the nozzle part; and adhering the membrane with the adhered nozzle part to a heat driving part such that the membrane is between the heat driving part and jetting fluid chambers of the nozzle part to form the fluid jetting apparatuses as an undivided unit, wherein the forming of the nozzle part comprises:

forming a nozzle plate on a first substrate by the spinning process;

forming the jetting fluid barriers on the nozzle plate by the spinning process;

forming a first reinforcing element on the first substrate;

forming the jetting fluid chambers between corresponding adjacent pairs of the jetting fluid barriers; and forming nozzles in the nozzle plate.

6. A process of manufacturing a plurality of fluid jetting apparatuses at once, comprising:

forming a nozzle part on silicon wafer by a spinning process, the forming the nozzle part comprising:

forming jetting fluid barriers on the nozzle plate by the spinning process;

forming a first reinforcing element on the first substrate;

forming jetting fluid chambers in the jetting fluid barriers; and forming nozzles in the nozzle plate;

forming a membrane, the forming the membrane comprising forming a polyimide coating layer on a second substrate of silicon wafer;

forming an adhesive polyimide coating layer on the polyimide coating layer;

forming a second reinforcing element on the adhesive polyimide coating layer; and separating the polyimide coating layer from the second substrate after forming the second reinforcing element on the adhesive polyimide coating layer;

adhering the nozzle part with the silicon wafer to the membrane;

removing the silicon wafer from the nozzle part; and adhering the membrane to a heat driving part.

7. The process of manufacturing a plurality of fluid jetting apparatuses as claimed in claim 6, forming the heat driving part, comprising forming electrodes and heat elements on a third substrate of silicon wafer;

forming driving fluid barriers on the electrodes and the heat driving elements; and forming driving fluid chambers in the driving fluid barriers.

8. A process of manufacturing a plurality of fluid jetting apparatuses at once, comprising:

forming a nozzle part on a silicon wafer by a spinning process;

adhering the nozzle part with the silicon wafer to a membrane;

removing the silicon wafer from the nozzle part;

adhering the membrane with the adhered nozzle part to a heat driving part such that the membrane is between the heat driving part and jetting fluid chambers of the nozzle part to form the fluid jetting apparatuses as an undivided unit;

forming the heat driving part, the forming the heat driving part comprising:

forming electrodes and heat elements on a substrate of another silicon wafer;

forming driving fluid barriers on the electrodes and the heat elements; and forming driving fluid chambers between corresponding pairs of the driving fluid barriers with the electrodes and the heat elements forming bottom sides of the corresponding driving fluid chambers and separated from the corresponding jetting fluid chambers by the membrane, each of the bottom sides being between the corresponding pair of the driving fluid barriers.

9. A process of manufacturing a plurality of fluid jetting apparatuses, comprising:

forming a nozzle part on a first substrate of silicon wafer by a first spinning process;

forming a membrane on a second substrate of silicon wafer by a second spinning process;

forming a heat driving part by forming electrodes and heat elements on a third substrate of silicon wafer;

removing first, second, and third substrates from the corresponding formed nozzle part, membrane, and heat driving part; and adhering the nozzle part to the membrane, and the membrane to the heat driving part to form the fluid jetting apparatuses as an undivided piece to be separated into individual fluid jetting apparatuses.

10. The process of manufacturing a plurality of fluid jetting apparatuses as claimed in claim 9, wherein:

the forming of the electrodes on the third substrate is performed by a lithography process or a wet etching process; and the forming of the heat elements on the third substrate is performed by the lithography process, the spinning process or a lift-off process.

11. The process of claim 9, further comprising splitting the adhered nozzle part, membrane, and heat driving part into separate fluid jetting apparatuses.

* * * * *